US009132315B1

(12) United States Patent
Chen

(10) Patent No.: US 9,132,315 B1
(45) Date of Patent: Sep. 15, 2015

(54) MULTIFUNCTIONAL ARMS AND WRISTS TRAINER

(71) Applicant: Chien-Rung Chen, Taipei (TW)

(72) Inventor: Chien-Rung Chen, Taipei (TW)

( * ) Notice: Subject to any disclaimer, the term of this patent is extended or adjusted under 35 U.S.C. 154(b) by 223 days.

(21) Appl. No.: 13/869,772

(22) Filed: Apr. 24, 2013

(51) Int. Cl.
*A63B 23/14* (2006.01)
*A63B 21/045* (2006.01)
*A63B 23/12* (2006.01)

(52) U.S. Cl.
CPC ..... *A63B 23/12* (2013.01)

(58) Field of Classification Search
CPC .... A63B 21/02; A63B 21/023; A63B 21/025; A63B 21/045; A63B 21/0455; A63B 21/05; A63B 23/12
USPC ..... 482/44–50, 92, 121–122, 126–128, 482/131–132
See application file for complete search history.

(56) References Cited

U.S. PATENT DOCUMENTS 2,821,394 A * 1/1958 Barbeau ..... 482/132
3,759,514 A * 9/1973 Cox ..... 482/126
4,095,789 A * 6/1978 Mueller ..... 482/127
4,643,417 A * 2/1987 Nieman ..... 482/46
4,651,985 A * 3/1987 Salisbury ..... 482/122
5,263,908 A * 11/1993 Chen ..... 482/44
5,643,158 A * 7/1997 Clementi ..... 482/121
5,707,325 A * 1/1998 Chiou ..... 482/132
6,328,680 B1 * 12/2001 Shifferaw ..... 482/132
7,951,052 B1 * 5/2011 Tang ..... 482/132
2011/0092346 A1 * 4/2011 Wakuda ..... 482/121
2012/0157274 A1 * 6/2012 MacColl et al. ..... 482/132
2012/0322630 A1 * 12/2012 Hood ..... 482/106

* cited by examiner

*Primary Examiner* — Stephen Crow
*Assistant Examiner* — Garrett Atkinson
(74) *Attorney, Agent, or Firm* — Pro-TECHTOR International Services; Ian Oglesby

(57) ABSTRACT

The present invention discloses a multifunctional arms and wrists trainer which is a bar assembled by a shaft and two handles. An interior of the bar is provided with an elastomer formed by a torsion spring or torsion leaf in a shape of ⊖. When two handles are held with two hands of a user and twisted against each other, muscle groups of arms are exercised by torsion resulted from the elastomer when the handles are twisted leftward and rightward. A handle bracket inside the handle can be also connected with a rotating dish which can be used as a roller for exercising abdominal muscles, in addition to being used to exercise the muscle groups of the arms by twisting the rotating dishes at a side.

7 Claims, 7 Drawing Sheets

MULTIFUNCTIONAL ARMS AND WRISTS TRAINER

BACKGROUND OF THE INVENTION a) Field of the Invention

The present invention relates to an arms and wrists trainer, and more particularly to a multifunctional arms and wrists trainer that exercises muscle groups of arms and can also be used as a roller device for exercising abdominal muscles.

b) Description of the Prior Art

A common arm strength trainer is a straight and elastic bar. A body builder will use the arm strength to bend the elastic bar inward to a U shape and then recover the elastic bar straight. He or she repeatedly operates in this way to exercise the arms. There is also another wrist trainer (i.e. a spring grip) in a triangular shape. The body builder will hold the spring grip with one hand and then squeezes and releases the spring grip to exercise wrists. However, the abovementioned arms and wrists trainers are only provided with a single function and cannot exercise muscle groups of the arms or the abdominal muscles effectively.

SUMMARY OF THE INVENTION

Proceeding from this, it is the primary object of the present invention is to develop an arm twisting force trainer, wherein in addition to that a bar can be held to twist up and down, a rotating dish at a side of the bar can be also held for sideway twist exercising. Furthermore, the rotating dishes at the sides of the bar can be used as rollers for exercising the abdominal muscles, as well.

To enable a further understanding of the said objectives and the technological methods of the invention herein, the brief description of the drawings below is followed by the detailed description of the preferred embodiments.

BRIEF DESCRIPTION OF THE DRAWINGS

FIG. 3-1 shows another cross-sectional view of the present invention wherein the rotating dishes are not idled.

DETAILED DESCRIPTION OF THE PREFERRED

Embodiments

Figure 1:
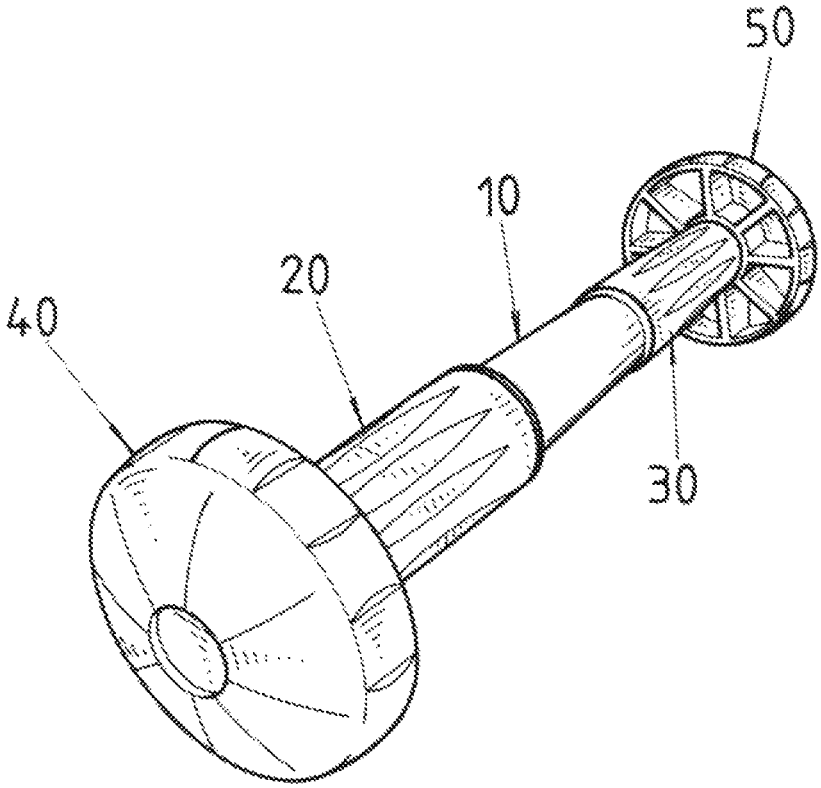
FIG. 1 shows a schematic view of the present invention.

Referring to FIG. 1, the present invention discloses a multifunctional arms and wrists trainer that comprises a shaft 10, two handles 20, 30 and two rotating dishes 40, 50.

Figure 2:
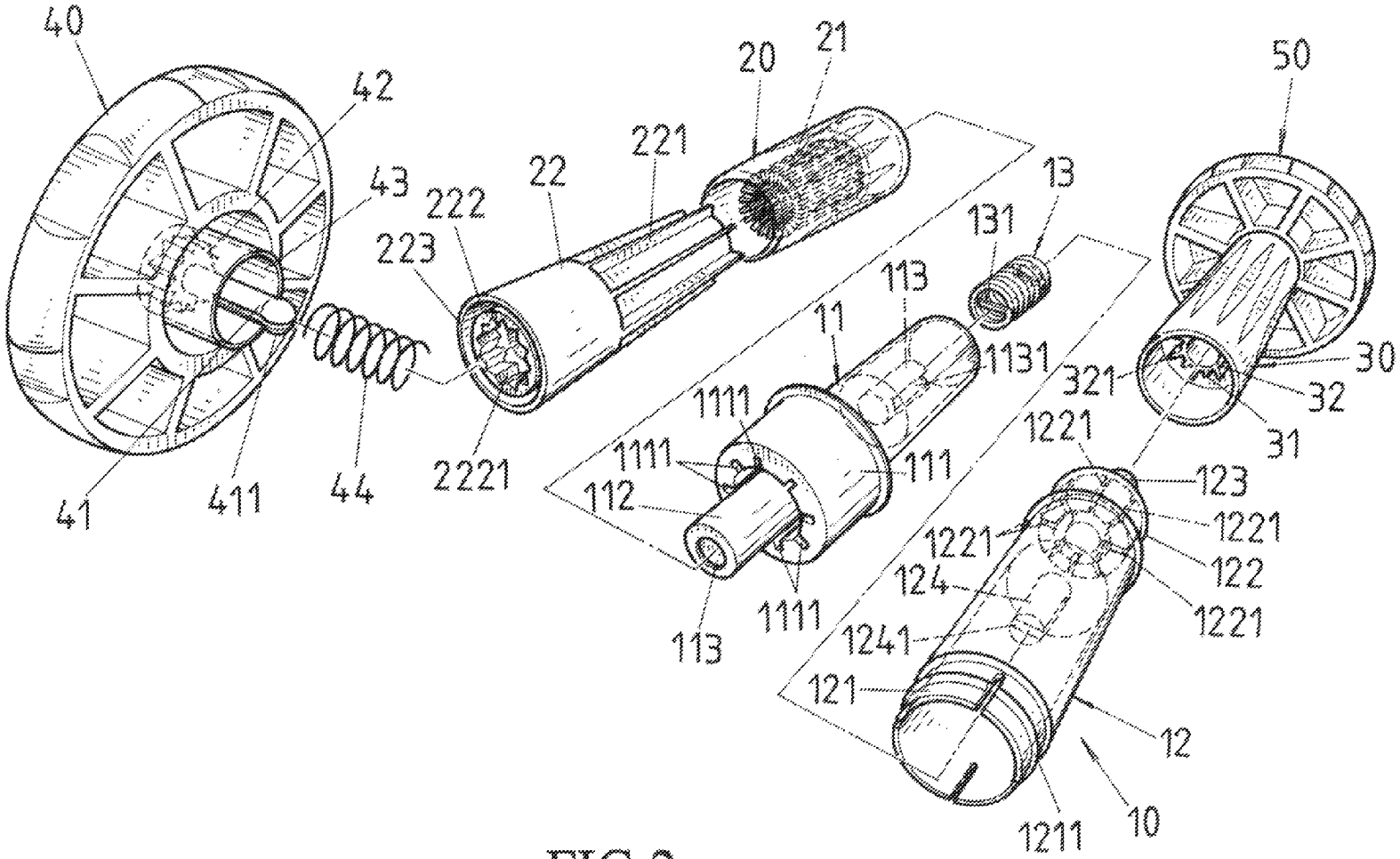
FIG. 2 shows an exploded view of the present invention.
Figure 3:
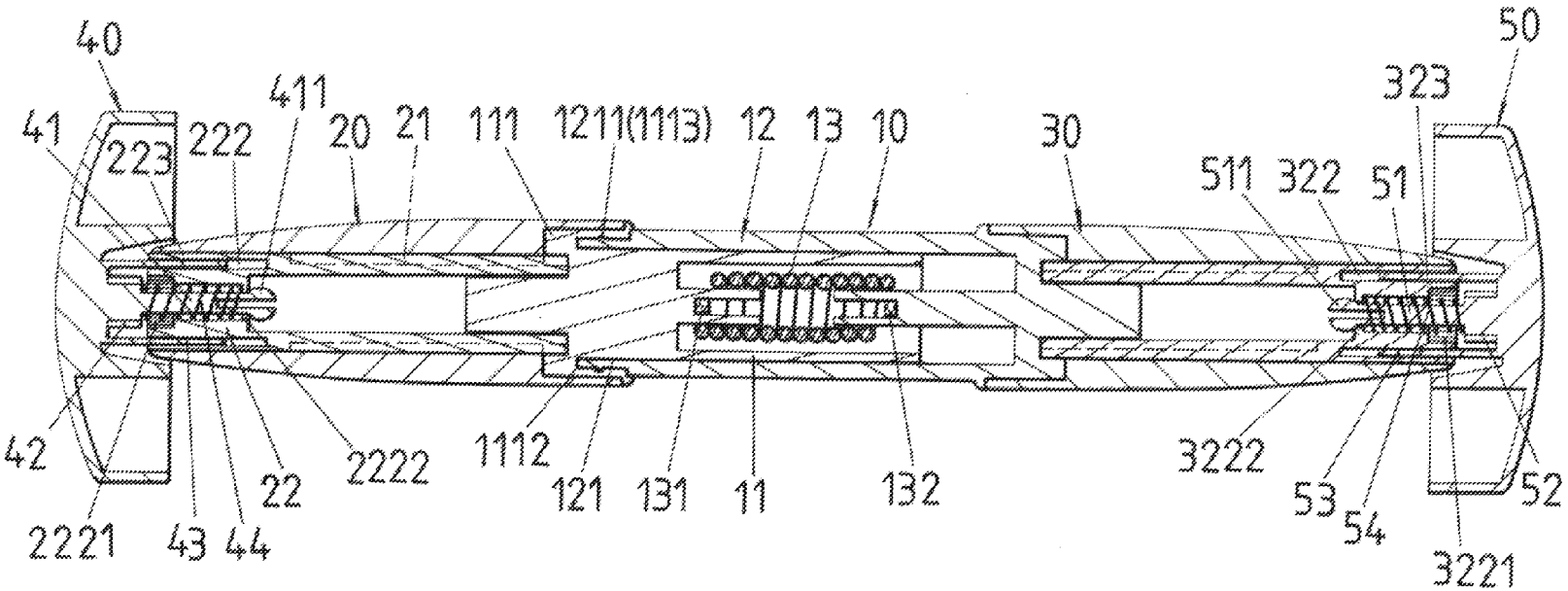
FIG. 3 shows a cross-sectional view of the present invention wherein rotating dishes are idled.
Figures 1, 3:
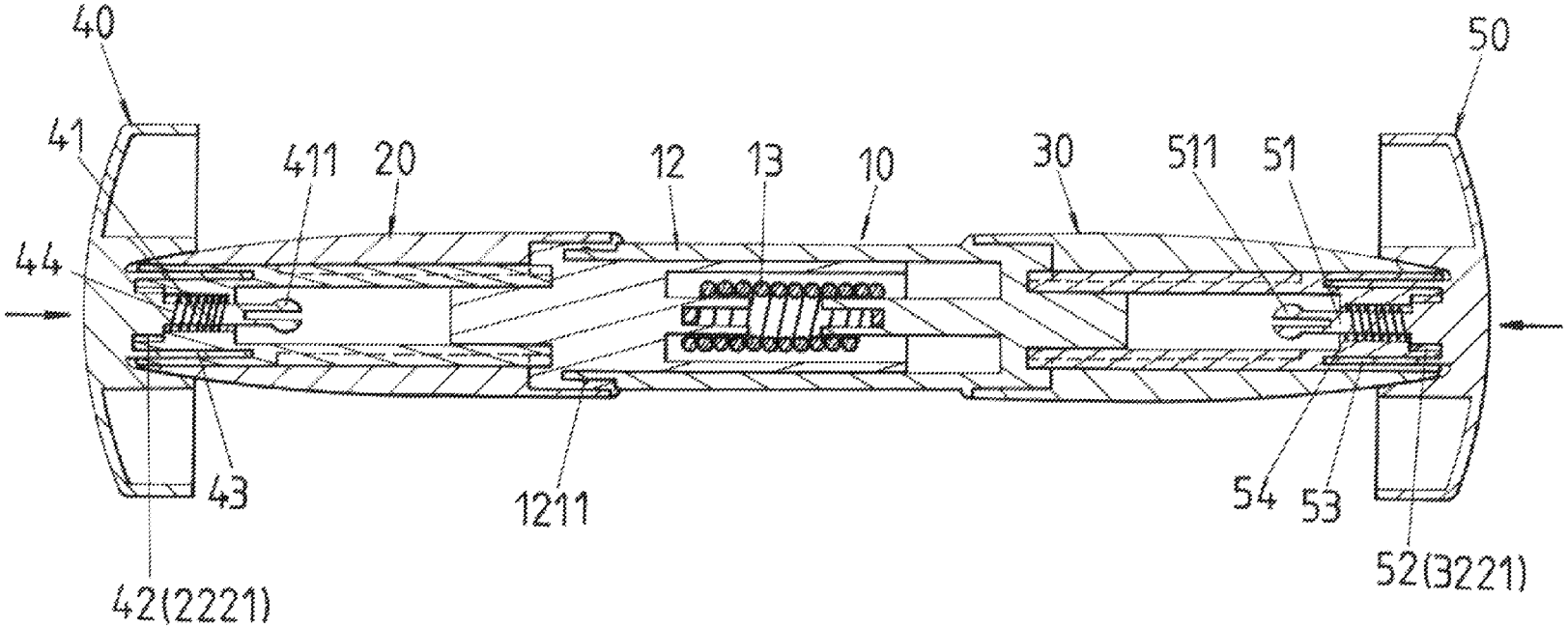

Referring to FIG. 2 and FIG. 3, the shaft 10 includes an inner tube 11, an outer tube 12 and an elastomer 13. An end of the inner tube 11 is provided with a sleeve 111, and an outer rim of the sleeve 111 is provided with a gear-shaped locking slot 1111; whereas, a center of the locking slot 1111 is protruded with a pole 112. An interior of the pole 112 is provided with a metal rod 113 which is extended into the inner tube 11; whereas, a center of the metal rod 113 is provided with an elastomer locking hole 1131. The elastomer 13 is a torsion spring in a shape of ⊖ and can be sheathed on the metal rod 113; whereas, a transversal rod 131 at one end of the elastomer 13 is latched into the elastomer locking hole 1131 of the metal rod 113. Referring to FIG. 3, an inner rim of the sleeve 111 of the inner tube 11 is provided with an annular slot 1112 and a center of the annular slot 1112 is provided with an annular hole 1113. A connection tube 121 at one end of the outer tube 12 is provided with a locking ring 1211, and when the outer tube 12 is sheathed on the inner tube 11, the connection tube 121 at one end is inserted into the annular slot 1112 of the sleeve 111 of the inner tube 11; whereas, the locking ring 1211 is fixed and positioned into the annular hole 1113. The other end of the outer tube 12 is also provided with a sleeve 122, an outer rim of the sleeve 122 is provided with a gear-shaped locking slot 1221, and a center of the locking slot 1221 is protruded with a pole 123. An interior of the pole 123 is provided with a metal rod 124 which is extended into the outer tube 12; whereas, a center of the metal rod 124 is provided with an elastomer locking hole 1241, and the transversal rod 132 at the other end of the elastomer 13 can be latched and positioned into the elastomer locking hole 1241 (as shown in FIG. 3).

The two handles 20, 30 can be made of a soft material and interiors of the handles 20, 30 are provided with gear-shaped locking slots 21, 31. A handle bracket 22 (32) is positioned by locking a gear-shaped locking pillar 221 (321) at one end into the locking slot 21 (31). The other end of the handle bracket 22 (32) is provided with a circular insertion block 222 (322) (as shown in FIG. 3), and an outer side of the insertion block 222 (322) is provided with a circular slot 223 (323). An inner rim of the insertion block 222 (322) is provided with a circular and sawtooth-shaped locking hole 2221 (3221); whereas, a center of the locking hole 2221 (3221) is an indented center hole 2222 (3222).

Two circular rotating dishes 40, 50 are connected at sides of the two handles 20, 30. An outer side of a center axis 41 (51) at one end of the handle 20 (30) is provided with a circular and sawtooth-shaped locking block 42 (52) and an outer side of the locking block 42 (52) is provided with a circular tube 43 (53). When assembling, the round tubes 43, 53 are latched into the circular slots 223, 323 of the handle brackets 22, 32, and the center axes 41, 51 are sheathed with springs 44, 54, followed by being extended into the locking holes 2221, 3221. A front end of the center axis 41 (51) is provided with a flexible axis block 411 (511) which is locked and positioned into the center hole 2222 (3222) of the handle bracket 22 (32). The sawtooth-shaped locking block 42 (52) is locked and fixed into the sawtooth-shaped locking hole 2221 (3221) of the handle bracket 22 (32) (as shown in FIG. 3-1).

Figure 4:
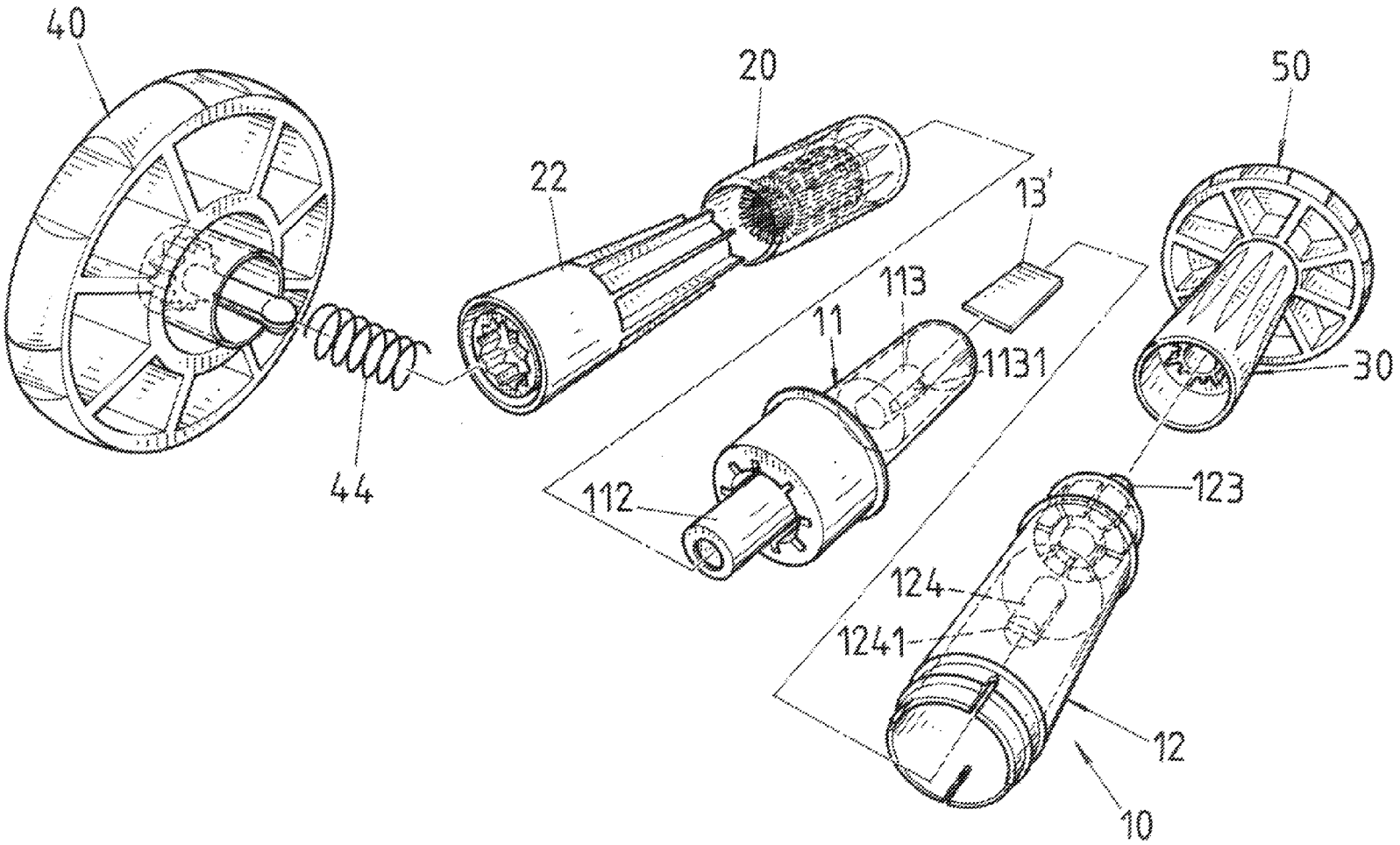
FIG. 4 shows an exploded view of another embodiment of the present invention.

Referring to FIG. 4, in addition to that the elastomer 13 inside the shaft 10 is a torsion spring in a shape of ⊖ as shown in FIG. 2, the elastomer 13 can be also a torsion leaf (or a rubber piece).

Figure 5:
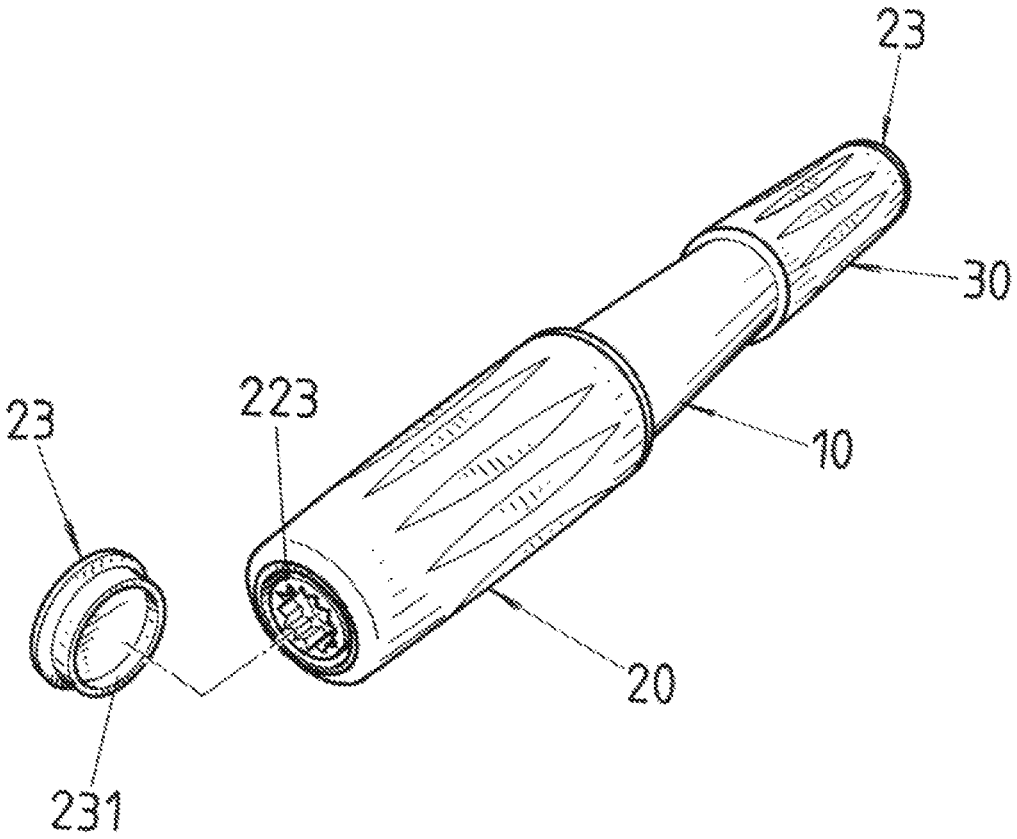
FIG. 5 shows a schematic view of another embodiment of the present invention.

Referring to FIG. 5, when the circular slot 223 at a side of the handle bracket 22 (32) inside the handle 20 (30) is not engaged with the rotating dish 40 (50), the circular slot 223 can be also latched with a cap rim 231 of a circular cap 23 to form a bar. Therefore, in addition to that two sides of the handles 20, 30 can be connected with the rotating dishes 40, 50, an object of weight can be also connected when the circular caps 23 are removed, turning into a dumb bell or an apparatus of other function.

There are many kinds of changes in terms of a usage state of the present invention, as described below.

Figure 6:
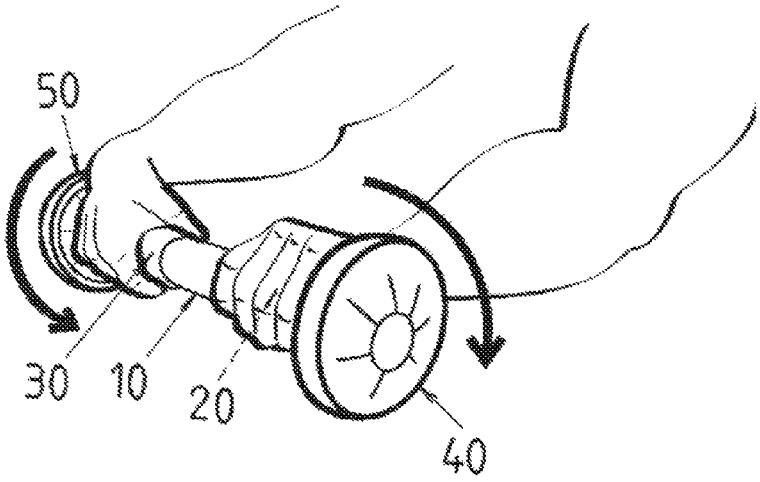
FIG. 6 shows a schematic view of a first embodiment of the present invention.

In the embodiment shown in FIG. 6, the two handles 20, 30 are held by two hands to twist forward, thereby exercising muscle groups of arms.

Figure 7:
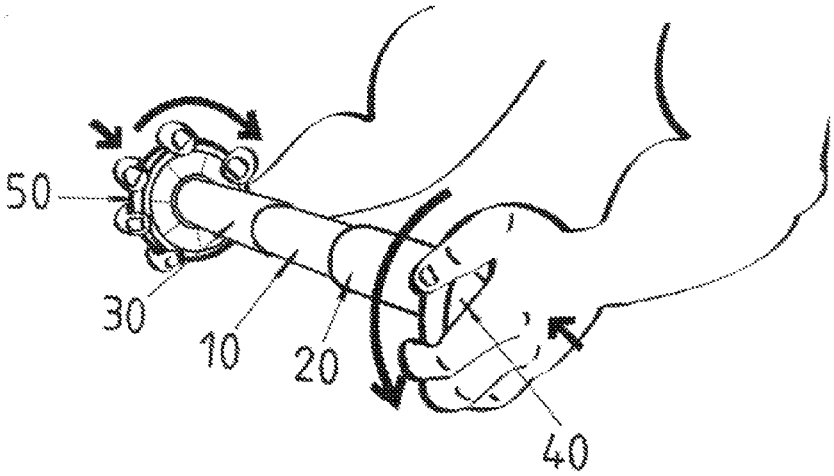
FIG. 7 shows a schematic view of a second embodiment of the present invention.

In the embodiment shown in FIG. 7, when the locking holes 2221, 3221 of the two handle brackets 22, 32 are fixed with the locking blocks 42, 52 of the two rotating dishes 40, 50 (as shown in FIG. 3-1), a body builder can hold the two rotating dishes 40, 50 with both hands to exercise the muscle groups of the arms by pulling the rotating dishes 40, 50 at a side.

Figure 8:
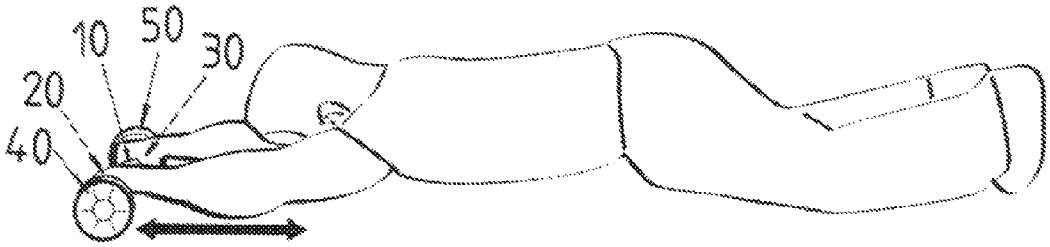
FIG. 8 shows a schematic view of a third embodiment of the present invention.

In the embodiment shown in FIG. 8, when the locking holes 2221, 3221 of the two handle brackets 22, 32 are separated with the locking blocks 42, 52 of the two rotating dishes 40, 50 (as shown in FIG. 3), the rotating dishes 40, 50 are idled and can be used as a roller apparatus for exercising abdominal muscles.

In conclusion, according to the above description of the embodiments of the present invention, the present invention is a bar, an interior of which is provided with an elastomer. When a user twists the bar forward or at a side, the muscle groups of the arms can be exercised using the torsion resulted from the elastomer. In addition, the bar can be also attached with rotating dishes or dumb bells, in order to exercise the abdominal muscles or the muscle groups of the wrists.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. Multifunctional arms and wrists trainer comprising:

a shaft, a pump comprising an inner tube, an outer tube and an elastomer, a sleeve on an end of the inner tube, a locking slot on an outer rim of the sleeve, a pole protruding through a center of the locking slot, a metal rod on an interior of the pole, the metal rod extending into the inner tube, an elastomer locking hole on a center of the metal rod, the elastomer sheathing the metal rod, a transverse rod at an end of the elastomer latching into the elastomer locking hole of the metal rod, an annular slot on an inner rim of the sleeve of the inner tube, an annular hole in a center of the annular slot, a locking ring on a connection tube at one end of the outer tube, the outer tube sheathing the inner tube, the locking ring locking into the annular hole, a sleeve on an other end of the outer tube, a locking slot on an outer rim of the outer tube, a pole protruding from a center of the locking slot, a metal rod on an interior of the pole, said metal rod extending into the outer tube, an elastomer locking hole on an end of the metal rod, the transversal rod at the other end of the elastomer latching into the elastomer locking hole; and two handles, a locking slot in an interior of each handle, an interior of the locking slot locks and positions a locking pillar of a handle bracket, an insertion block on an end of the handle bracket, a circular slot on an outer side of the insertion block, a locking hole on an inner rim of the insertion block, and a center hole in a center of the locking hole;

wherein the handles are adapted to be held and twisted by two hands of a user to exercise the user's arm muscles.

2. The multifunctional arms and wrists trainer according to claim 1, further comprising a circular tube of a rotating dish latching an interior of the circular slot of the handle bracket, a circular and sawtooth-shaped locking block on an outer side of a center axis at an end of the rotating dish, a circular tube on an outer side of the locking block, a spring sheathing a center axis, the center axis extending into the locking hole, an axis block at a front end of the center axis locking into the center hole of the handle bracket, and the locking block locking into the locking hole of the handle bracket.

3. The multifunctional arms and wrists trainer according to claim 1, wherein the locking slots inside the shaft and on the outer rim of the sleeve of the outer tube are in a sawtooth shape.

4. The multifunctional arms and wrists trainer according to claim 1, wherein the elastomer inside the shaft is a torsion spring or torsion leaf in a shape of ⊖.

5. The multifunctional arms and wrists trainer according to claim 1, wherein the locking slot that is concaved inside the handle is in a sawtooth shape.

6. The multifunctional arms and wrists trainer according to claim 1, wherein the locking hole on the inner rim of the insertion block at one end of the handle bracket is in a circular and sawtooth shape.

7. The multifunctional arms and wrists trainer according to claim 1, further comprising a circular cap, wherein an interior of the circular slot of the handle bracket latches a circular tube of a rotating dish, and wherein when the two handles are not connected with the rotating dishes, a circular cap is adapted to be attached to the circular slot inside the handle bracket by latching and positioning a cap rim of the circular cap into the circular slot.

* * * * *